US005120245A

United States Patent [19]

Robertson et al.

[11] Patent Number: 5,120,245

[45] Date of Patent: Jun. 9, 1992

[54] PLUGGABLE CONNECTOR FOR USE WITH INSULATION DISPLACING BARREL TERMINALS

[75] Inventors: James W. Robertson, Oberlin; Francis J. Shay, Palmyra, both of Pa.

[73] Assignee: AMP Incorporated, Harrisburg, Pa.

[21] Appl. No.: 697,921

[22] Filed: May 2, 1991

Related U.S. Application Data

[63] Continuation of Ser. No. 491,016, Mar. 9, 1990, abandoned.

[51] Int. Cl.[5] ..... H01R 4/24

[52] U.S. Cl. ..... 439/395; 439/936

[58] Field of Search ..... 439/276, 395, 399, 400, 439/409, 410, 936; 361/426

[56] References Cited

U.S. PATENT DOCUMENTS

| | | | |
|---|---|---|---|
| 4,236,779 | 12/1980 | Tang | 439/610 |
| 4,767,353 | 8/1988 | Hughes et al. | 439/398 |
| 4,835,659 | 5/1989 | Goodson | 361/390 |

*Primary Examiner*—Larry I. Schwartz
*Assistant Examiner*—J. R. Daulton
*Attorney, Agent, or Firm*—Bruce J. Wolstoncroft; Anton P. Ness

[57] ABSTRACT

An assembly including a housing having a base section from which extend a plurality of silos each housing a terminal having wire terminating sections at or near each end. Along a wire receiving face, first wire terminating sections of the terminals are exposed by wall openings permitting wire insertion for wire termination. Along an interconnection face, second wire termination sections are terminated to wires which extend to other terminals within an electrical connector which is embedded by sealing material along the base section with a mating face exposed, and the wire lengths and terminal ends are also embedded and sealed. The terminals may each have two cylindrical parts with an outer section rotatable within the silo about an inner section to terminate to a wire end inserted into a wall opening of the silo, using insulation displacement slots.

3 Claims, 12 Drawing Sheets

PLUGGABLE CONNECTOR FOR USE WITH INSULATION DISPLACING BARREL TERMINALS

REFERENCE TO RELATED APPLICATION

This is a continuation application of U.S. Pat. application Ser. No. 07/491,016 filed Mar. 9, 1990, now abandoned.

BACKGROUND OF THE INVENTION

1. Field of the Invention

The invention relates to a terminal receiving block which has a pluggable connector provided at one end thereof. The pluggable connector is electrically connected to terminals, each terminal has at least one wire receiving slot provided at an end thereof for the insertion of respective wires therethrough.

2. Description of the Prior Art

There are many instances where terminal blocks are set up in arrays for receipt of wires therein. Many of these terminal blocks are simply threaded members fixed with insulation material which receive wires either wrapped around the threaded members and secured thereto by an application of a nut, or the wires are terminated by known spade or ring terminals and then secured to the threaded member by a nut. While these have, in some instances, provided effective means for termination, they have not always been convenient for installation, maintenance, or repair and they frequently are subjected to environmental degradation with a resulting loss of desired electrical characteristics.

There is a need, predominantly within the telecommunications industry for reusable terminals, and terminals which can accommodate more than one conductor size. The telephone wires coming from the phone company can either be in the form of buried cable or aerial wires. The terminal blocks would be mounted in either an enclosure on the aerial mount, or in an enclosed pedestal affixed to the ground, or on a pole. As new telephones are installed in a selected locality, the phone wires are then terminated to the respective terminals on the high density array.

As the terminals can be used over many cycles, there is a possibility of damaging a respective terminal or terminal block. Consequently, there is a need to provide a terminal block which can be easily removed and replaced with minimal effort and minimal tooling. This is of particular importance because the terminal blocks are provided in field locations, i.e. on poles, etc. However, the present devices are not easily replaced.

There is also a need, particularly in applications in which the terminals are to be terminated in the field, for the terminals to be easily installed. As many wires are required for operation, it is essential that the installation of the wires be accomplished with minimal effort and minimal tooling. However, the present devices are not easily installed, and consequently, the cost of the installation is significant.

While the preferred embodiment of connector disclosed herein is for telecommunications applications, for example for electrical interconnection of tip and ring voice signals, the invention could be used with other wire sizes and in other applications.

U.S. Pat. No. 4,431,247 shows an insulated terminal and module, however the shell of the terminal only includes one wire opening for insulation displacement.

Other previous designs are shown in U.S. Pat. Nos. 4,637,675 and 4,705,340 where stationary terminals are located within housings and rotatable caps are placed over the terminals. Rotation of the cap causes the wires within the caps to be rotated into the stationary insulation displacement portions. While the previous versions shown in the '675 and '340 patents are excellent designs, these designs include shortcomings which have been addressed by the instant design.

A major shortcoming with respect to the prior art connectors relates to the ease of installation and repair. In order for the terminal blocks to be connected to the system, there is a need for labor intensive operations. The wires which extend from the bottom of the terminals must be spliced to appropriate wires of the cable. This is very time consuming and difficult, particularly in field applications.

The newly designed terminal and connector which we have invented has rectified these earlier shortcomings and is summarily explained below.

SUMMARY OF THE INVENTION

The present invention is directed to a terminal block which is pluggable into a pedestal or the like. This pluggable terminal block allows for easy installation and replaces the labor intensive operation currently used to terminate the terminal block to the cable.

In particular, the insulation displacement type connector has a housing with at least one cavity defined by a cylindrical wall, and a wire receiving opening which extends through the wall and into the interior of the cavity. A cylinder formed of conductive material defining a tubular wall is positioned in the cavity. The cylinder has at least one wire receiving entry through the wall thereof, the entry is initially aligned with the wire receiving opening of the housing. A pluggable means is provided in the insulation displacement connector, the pluggable means is electrically connected to the cylinder and mounted on the housing. Such that as the insulation displacement type connector is mounted to a mating or interconnection surface, the pluggable means is positioned to cooperate with a respective mating pluggable member to insure that the insulation displacement type connector is placed in electrical engagement with the mating connector.

Discrete wires are provided in the insulation displacement type connector, the discrete wires are provided to electrically connect the conductive cylinders of the housing to respective contacts of the pluggable means.

A sealing material is provided proximate the mating surface of the insulation displacement type connector, the sealing material cooperates with lower portions of the conductive cylinders and the discrete wires to provide an environmental seal thereabout. The wire receiving face of the electrical connector is also positioned in the sealing material. The sealing material cooperates with the wire receiving face and the discrete wires to form an environmental seal thereabout, the sealing material also cooperates with the electrical connector to maintain the electrical connector in position relative to the insulation displacement type connector.

BRIEF DESCRIPTION OF THE DRAWINGS

FIG. 3 is a front plan view showing the two piece terminal of FIG. 2.

FIG. 8 is a stamped blank of the upper portion of the terminal prior to being rolled into a barrel terminal.

DESCRIPTION OF THE PREFERRED EMBODIMENT

Figure 1:
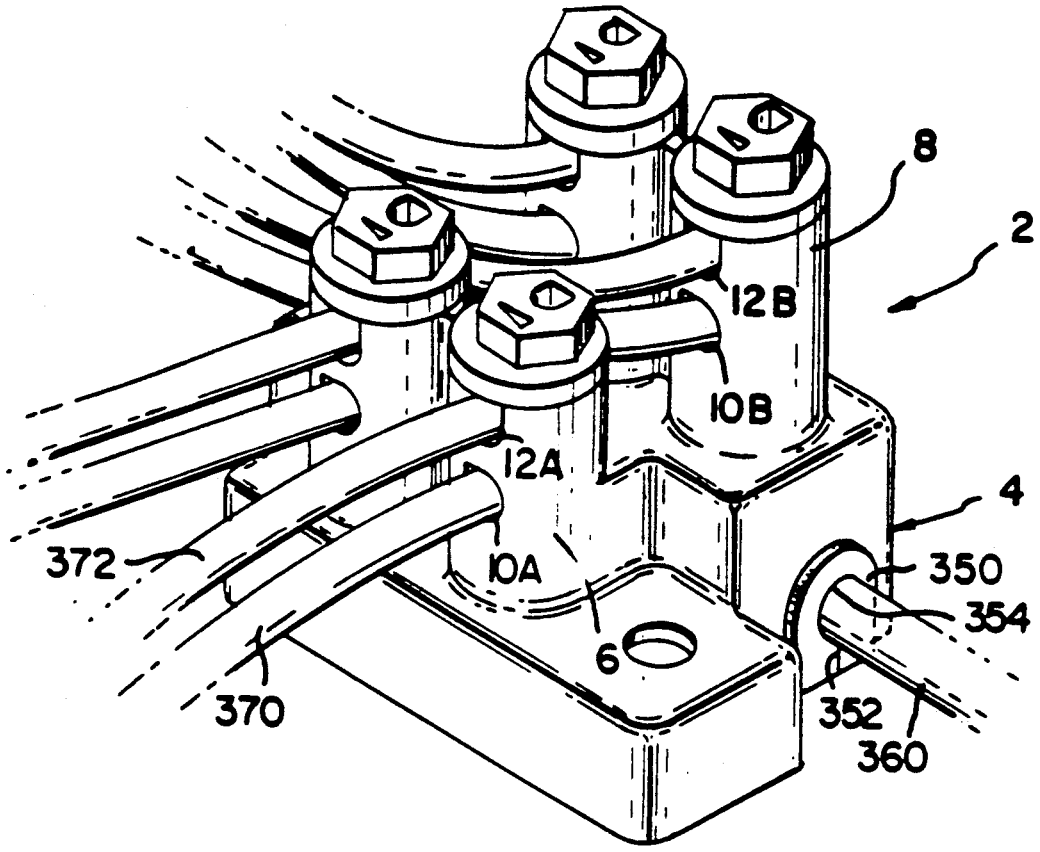
FIG. 1 is a perspective view showing a high density array of terminals and caps.
Figure 6:
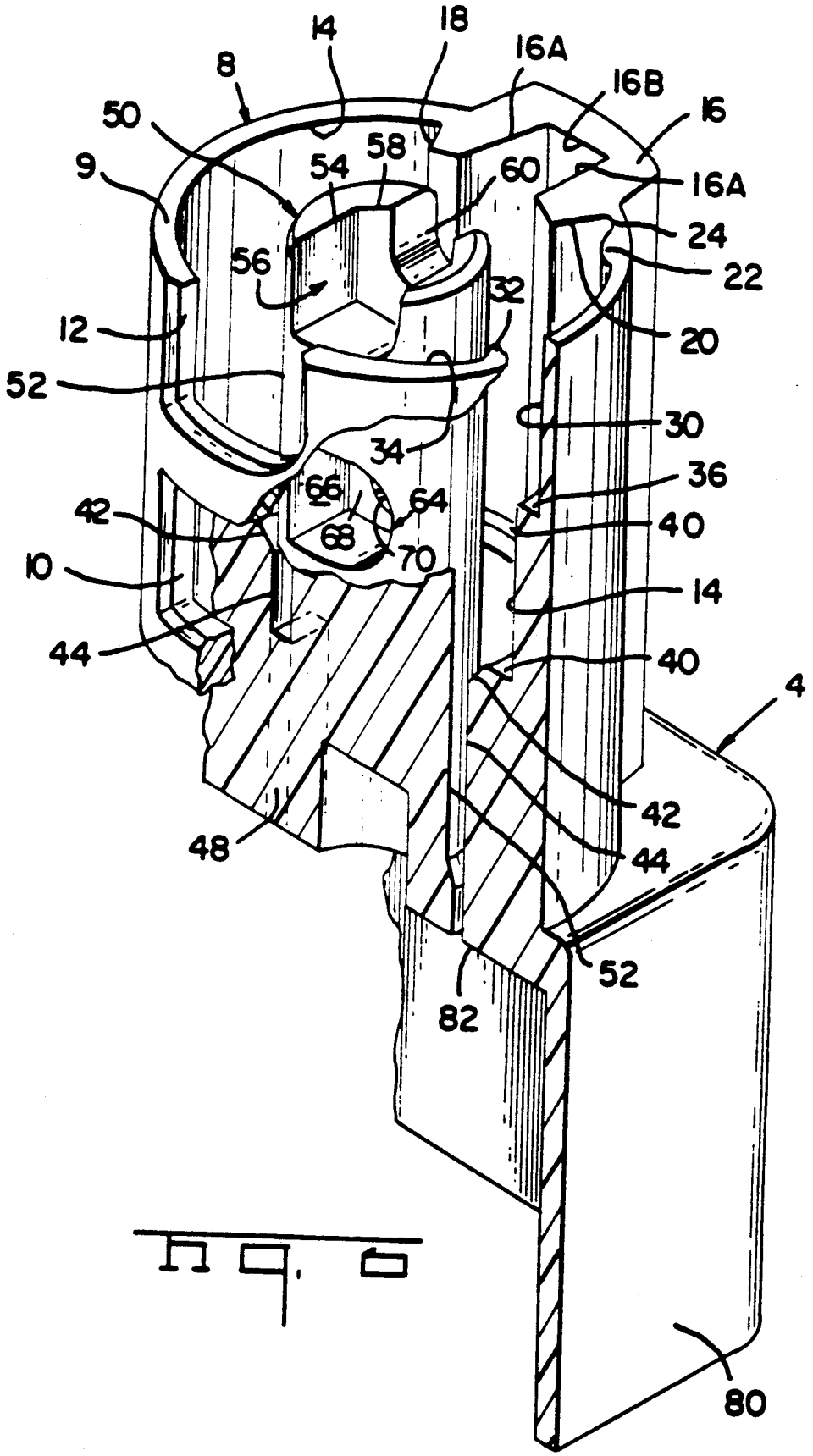
FIG. 6 is an isometric view, partially cut away, through the housing.
Figure 7:
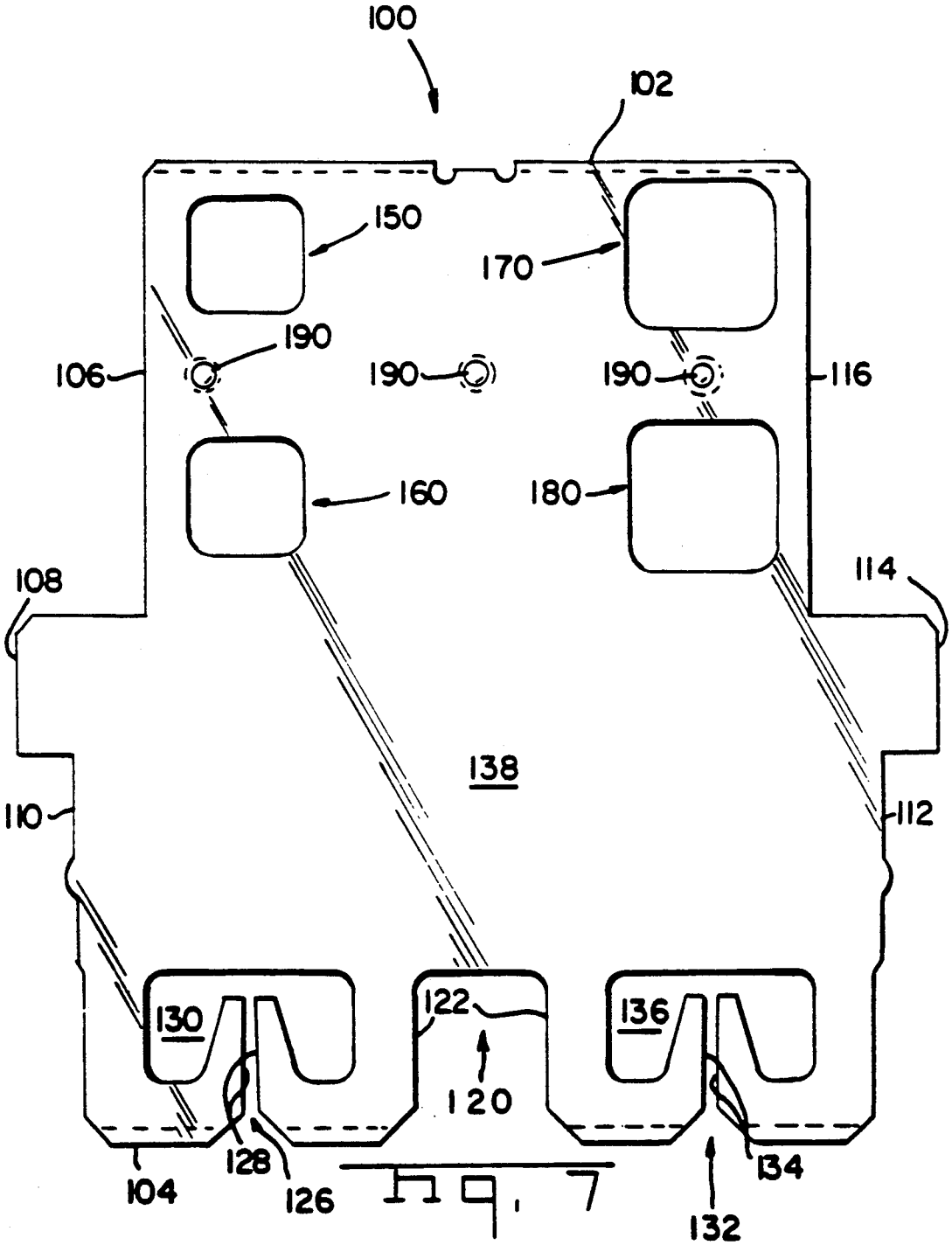
Figure 1:
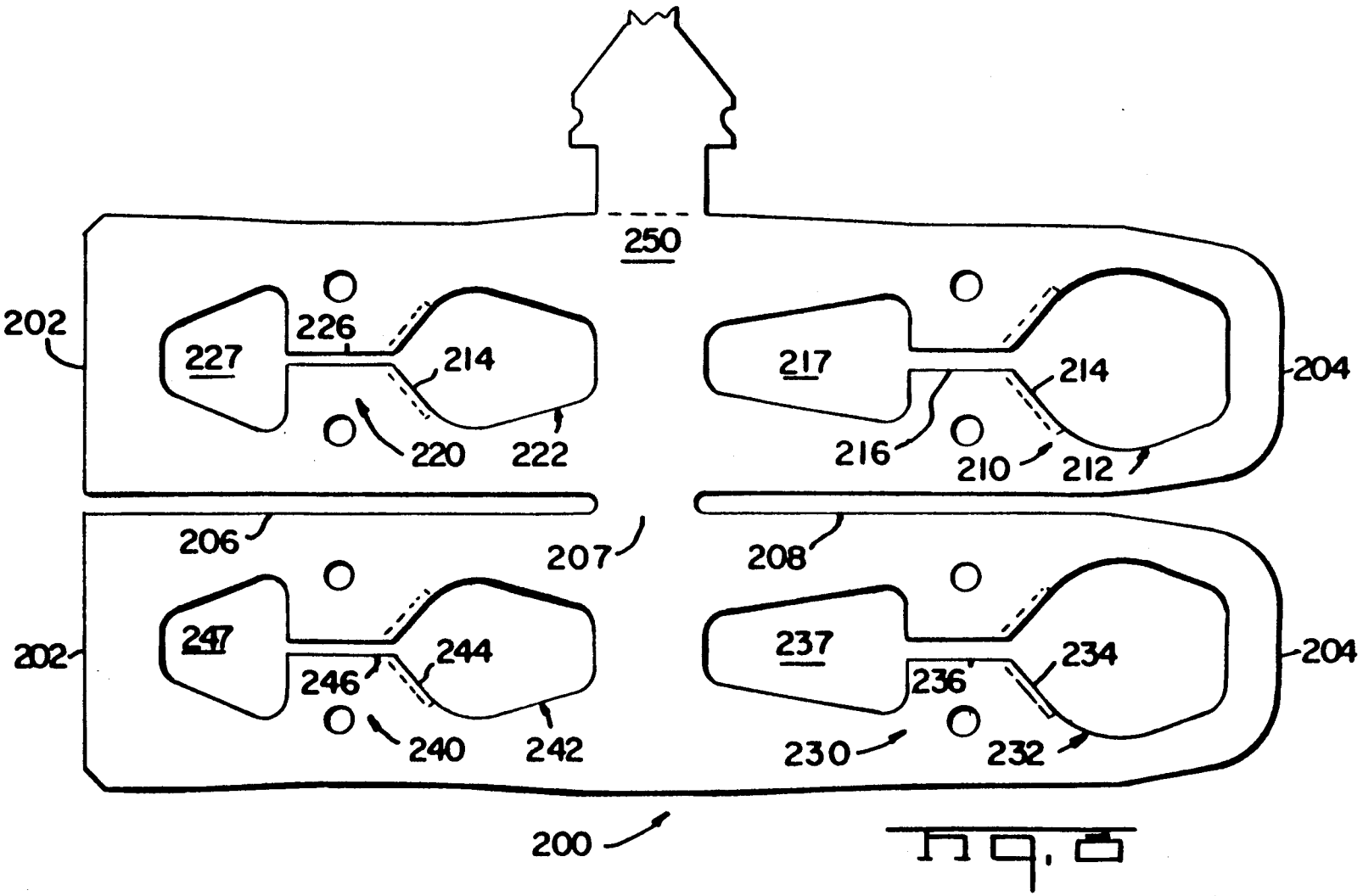

With reference first to FIG. 1, an electrical connector 2 is shown which includes an insulative housing member such as 4 including a plurality of silo members, such as 6 and 8, disposed in two opposed rows and extending to a wire receiving face from a transverse housing base section. With reference now to FIG. 6, the housing member will be described in greater detail, and it should be noted that FIG. 6 shows the internal structure of silo 8 in particular; however it should be noted that the internal structure of silo 6 is identical to that of silo 8. Both silos 6 and 8 include an internal diameter such as 14 which extends circumferentially around the internal surface of the silo where it ends with stop surfaces 18 and 20. A longitudinally extending channel 16 extends along the length of the silo and includes opposed parallel surfaces 16A and an end surface 16B. Along a portion of the internal circumferential surface, proximate to stop surface 20 is a first detent member 22 which defines a recessed section 24 adjacent to the stop surface 20 and further defines a shallow surface 30. A second detent member 32 is located beyond the first detent member 22 and defines a second shallow surface 34. Surface 34 is gradually increasing in thickness from a position just beyond the detent 32, and increases in thickness upon radial movement from the detent member 32 to the opening 12. Each of the surfaces 30 and 34 extend only partially along the length of the silo thereby defining a floor such as 36 partially along the length thereof. Internal circumferential surface 14 extends from the floor 36 downwardly to a second floor such as 40. Beneath the floor 40 is a circumferential surface 44 having a lead in such as 42.

A generally solid post member 50 is integral with the entirety of the housing 4 and integrally molded therewith via a web section shown in phantom as 48 in FIG. 6. The outer diameter of the post is shown as 52 and forms a terminal receiving area in conjunction with the inner surface 44. Two wire selector through openings 56 and 64 are included in the post and are radially and longitudinally aligned with the openings 12 and 10 in the silo of the housing respectively. The upper opening 56 includes first spaced-apart walls 54 which are in transition with a lead-in section 58 thereby leading into a slot such as 60. It should be noted that the openings 12 and 56 are in radial alignment with the center of the channel 16. The lower wire selector opening 64 includes first spaced apart walls 66 in transition with a second lead-in surface 68 which then transitions into a smaller opening 70. Similarly, the openings 10 and 64 are all in radial alignment with the center of the channel 16, relative to the center of the post 50.

Figure 7:
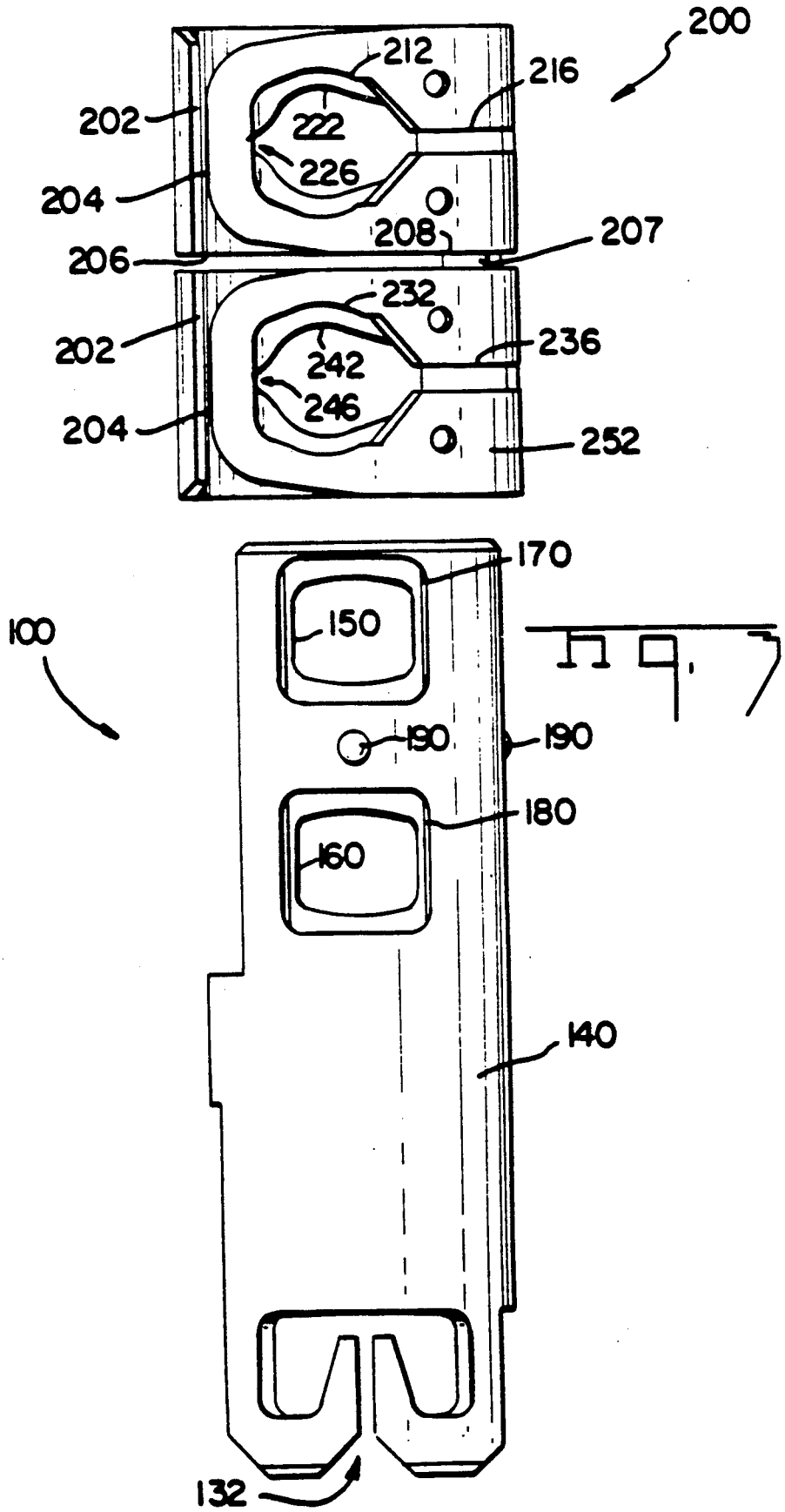
FIG. 7 is a stamped blank of the lower portion of the terminal prior to being rolled into a barrel terminal.

Referring now to FIG. 7, a lower terminal section 100 is shown as generally including an upper edge 102, a lower edge 104, side edges 106, 108 and 110 on one side thereof and side edges 116, 114 and 112 on the opposite side thereof. Wire receiving slots such as 126 and 132 are included extending upwardly from the lower edge 104 and include wire terminating edges 128 and 134, respectively. At the lower edge thereof is an opening such as 120 which is defined by two parallel and opposed side edges 122; opening 120 provides a mechanical relief area between the two wire receiving slots 126 and 132. To further prevent overstressing of lower wire receiving slots 126 and 132, recessed areas 130 and 136 are included surrounding the wire terminating edges 128 and 134, respectively.

At the upper portion of lower terminal section 100, two small wire openings 150 and 160 are included at the left margin, while two large wire openings 170 and 180 are included at the right hand margin. The upper portion of lower terminal section 100 further includes three contact members 190, which when viewed from FIG. 7 would project through the bottom side of the paper rather than through the viewing side. lower terminal 100 when formed will have side edges 114 and 108 in a substantially abutting relation such that side edges 110 and 112 and side edges 106 and 116 respectively are in a spaced apart relation with each other. It should also be noted from FIG. 3 that the pairs of large and small wire openings 170 and 150, and 180 and 160 are opposed from each other, in radial alignment through the center of the terminal.

As shown in FIG. 8, upper terminal section 200 is shown as including side edges 202 and 204, while a plurality of wire receiving openings and wire receiving slots are shown in communication with one another. For example, a large IDC section 210 includes a large wire receiving opening 212 in communication with a large wire terminating section 216. Further IDC sections 220, 230 and 240 are included having similar openings in communication with similar slots. Behind each of the wire receiving slots such as 216, a relief area such as 217 is included to insure that when the conductor of the wire is moved into the terminating condition, the section adjacent to the end of the wire terminating slot 216 is not overstressed. As formed in FIG. 3, side edges 202 and 204 are brought towards each other until the shape of upper terminal section 200 is substantially cylindrical, although a small gap exists between their ends as explained more fully herein. It should be noted that the large wire openings 212 and 232 are opposed and in radial alignment with small wire openings 222 and 242, respectively.

Figure 5:
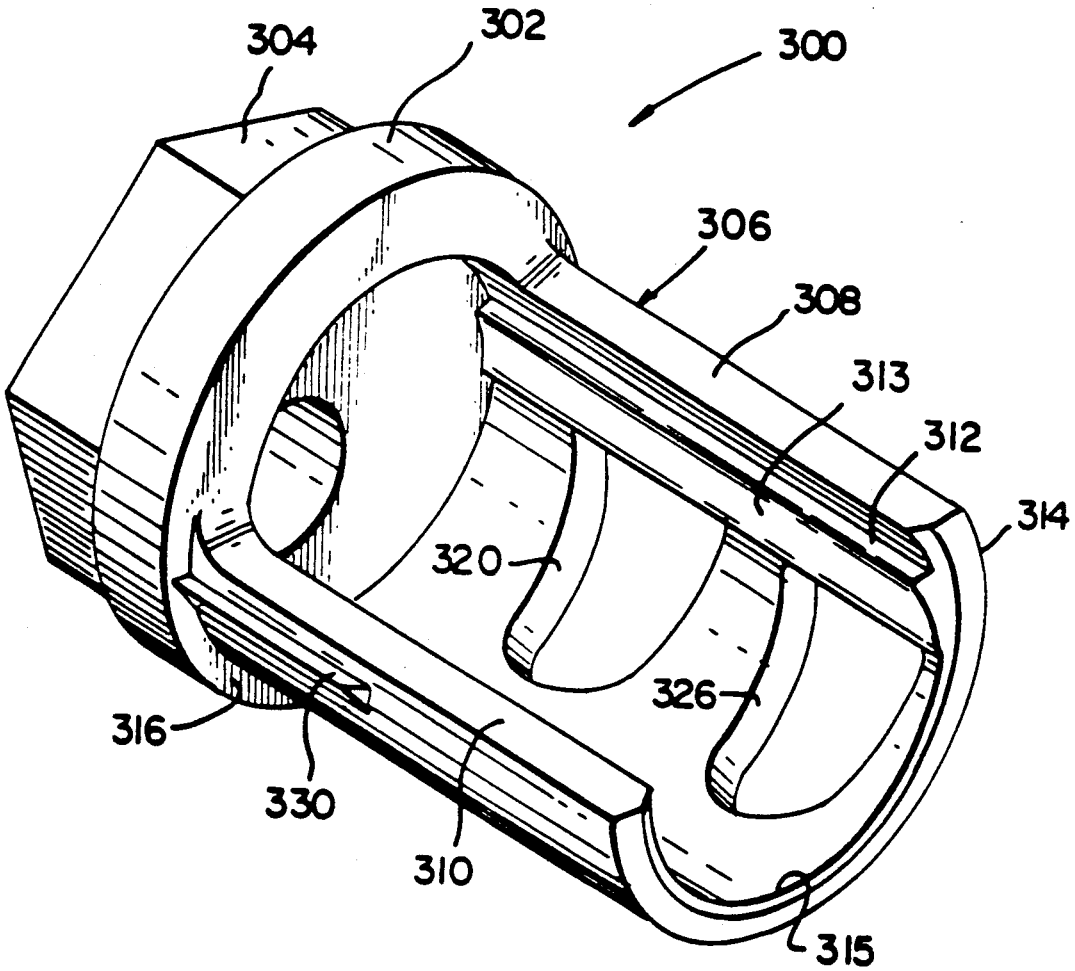
FIG. 5 is an isometric view of the cap portion.

Referring now to FIG. 5, an insulative cap 300 is shown including a circular structural portion 302 with a driver nut portion 304 integrally molded above circular portion 302. A partially cylindrical portion 306 is integrally formed with cylindrical portion 302 and extends downwardly therefrom having stop edges 308 and 310. A rotation bar 313 is also included on the inner surface 315 of the cap and has a forward bearing surface such as 312. Two through openings 320 and 326 in the cap extend inwardly between an outer diameter 314 and an inner diameter 315.

Figure 2:
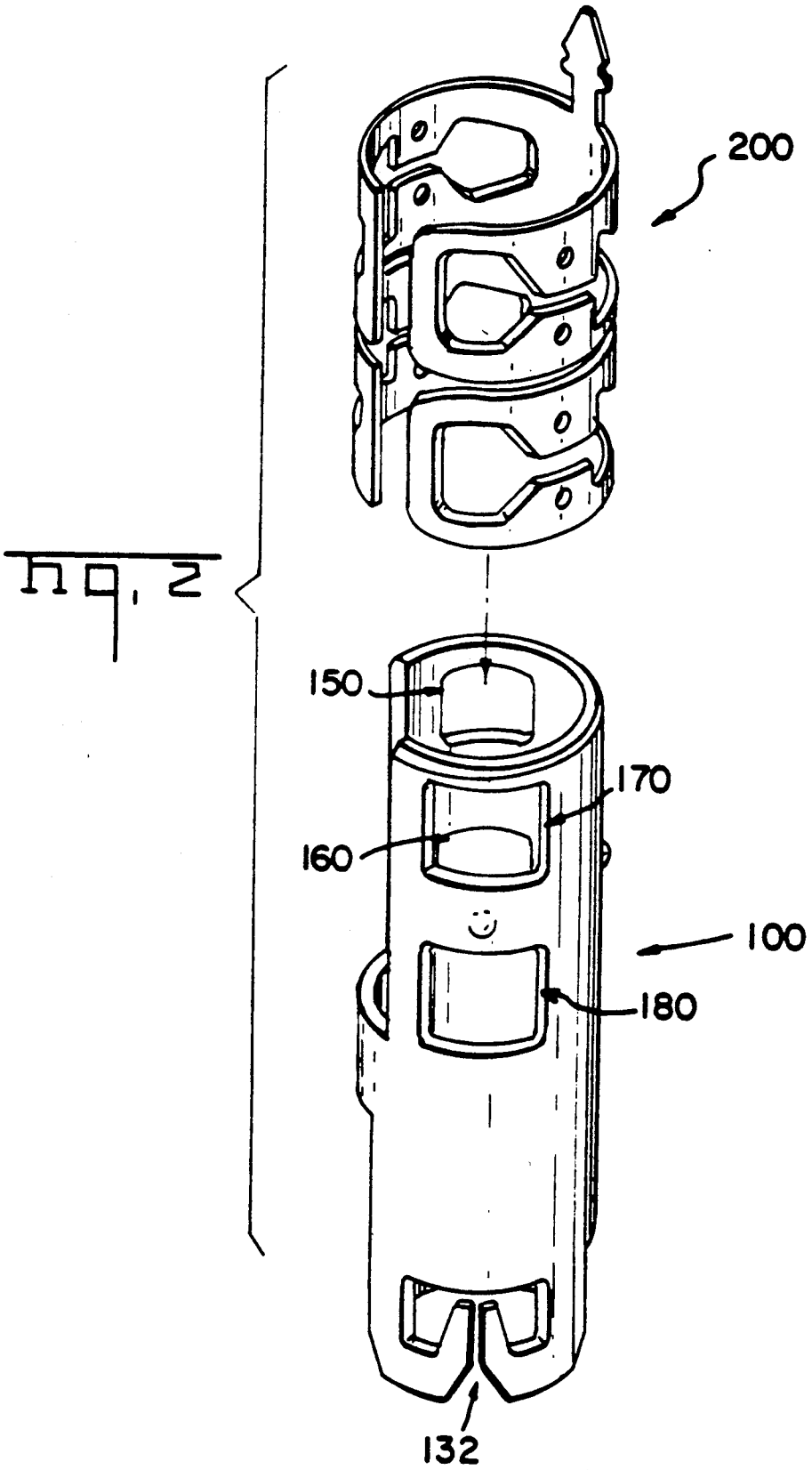
FIG. 2 is a perspective view of the subject two piece terminal exploded apart.
Figure 9:
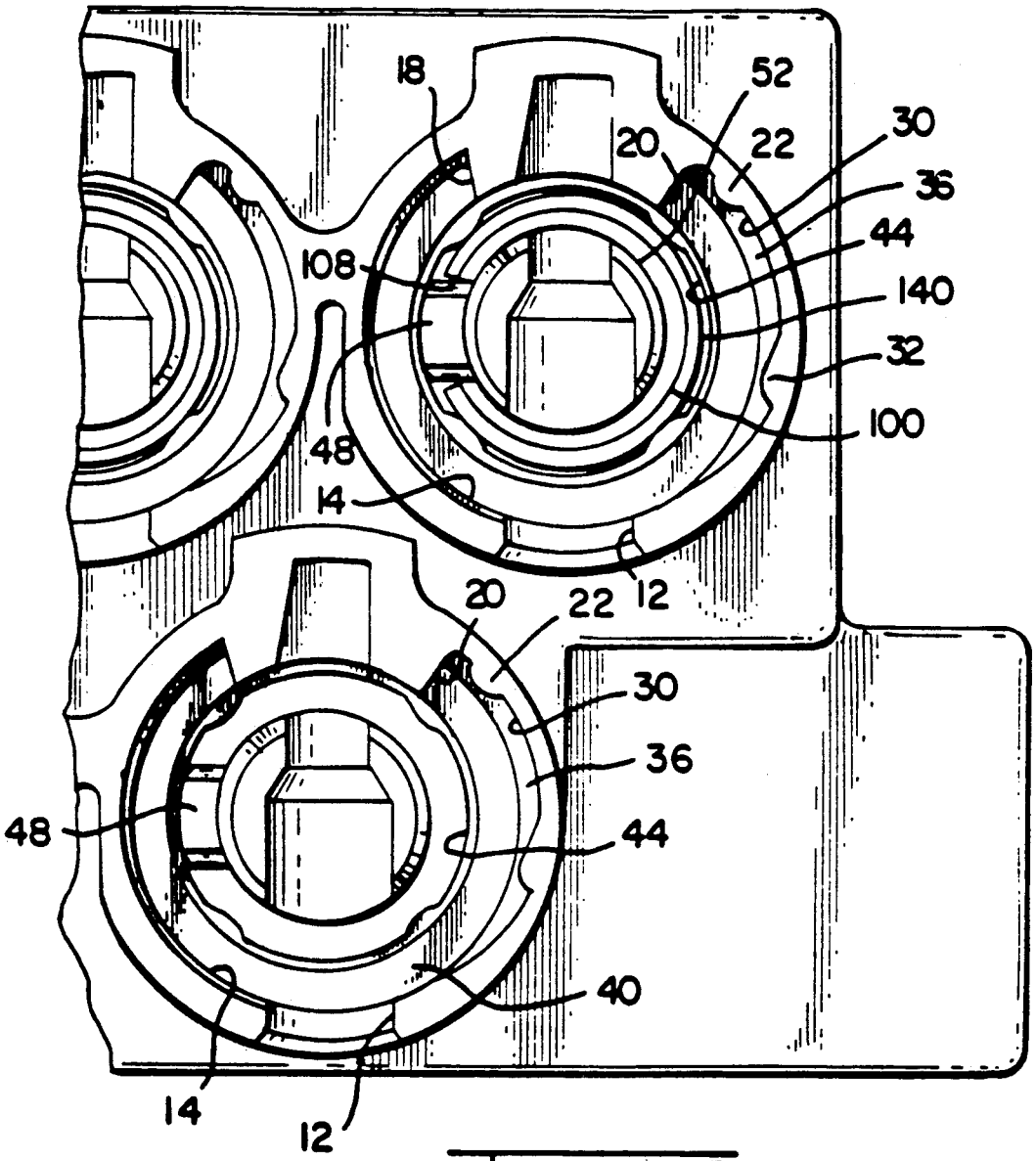
FIG. 9 is a top view of a section of the housing.

To assemble the connector with the lower section of terminal 100 as formed in FIG. 3, the lower section 100 is inserted over the post 50 such that the opening created between side edges 110 and 112 (FIGS. 2 and 7) of the lower terminal section fit over lug 48 as shown in FIG. 6. This prevents the rotation of lower terminal section 100 during the rotation of the upper terminal section 200. The lower terminal section 100 is placed adjacent to the outer diameter 52 of the post 50 and adjacent to the inner surface 44 of the silo, as shown in FIG. 9, with wire terminating sections 126 and 132 extending beyond surface 82 of the housing 80, as shown in FIG. 6. This also places side edges 110 and 112 adjacent to the side edges of lug 48 to ensure that lower terminal section 100 remains rotationally stationary relative to housing 4. When lower terminal section 100 is inserted between the silo and post, upper edge 102 of terminal section 100 is approximately flush with upper edge 9 of the silo (FIG. 6) such that large openings 170 and 180 of the lower terminal section 100 are aligned with openings 12 and 56, and with openings 10 and 64 in the silo and inner post 50, respectively.

To further complete the assembly, upper terminal section 200 is inserted into the cap with the gap between side edges 202 and 204 of upper terminal section 200 slidably received between rotation bar 313 (FIG. 5) such that surface 202 abuts bearing surface 312. In this manner, outer surface 252 (FIG. 3) of terminal 200 will be adjacent to the inner surface 315 of the cap. It should also be noted that with the cap and terminal assembled as just described, openings 320 and 326 in the cap are adjacent to and in alignment with, the large wire receiving openings 212 and 232 in upper terminal section 200, respectively.

Figure 4A:
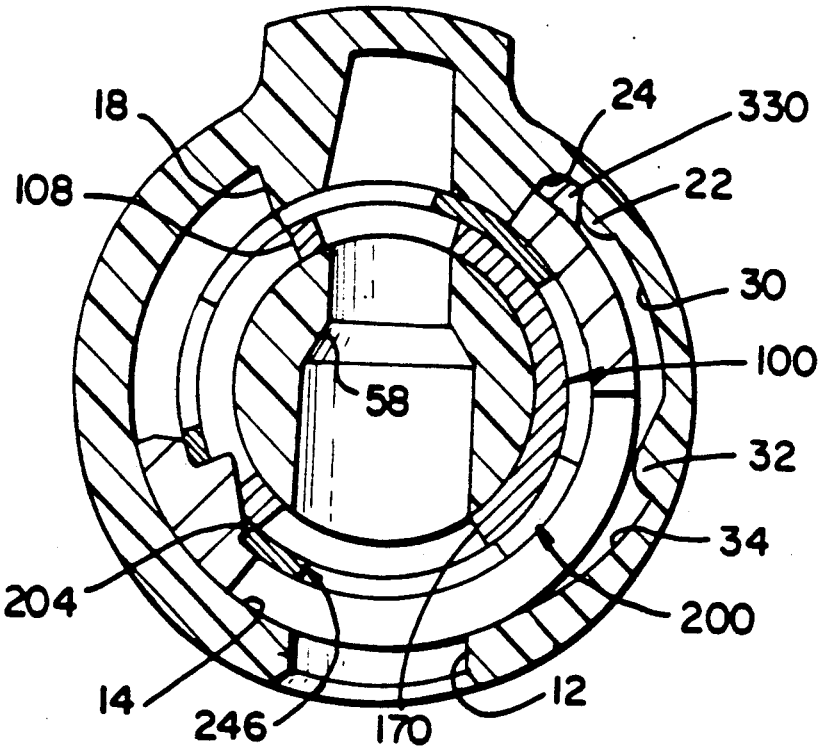
FIG. 4A is a cross sectional view through the upper insulation displacement slot showing the cap and upper terminal in the fully open position.

The cap 300 and the upper terminal section 200 are then insertable within an individual silo between inner surface 14 of the silo the outer surface 140 of the lower terminal section. The cap 300 is placed in the silo such that the radial void between the edges 308 and 310 (FIG. 5) of the cap are between the stop surfaces 18 and 20 within the interior of the silos, and more particularly with edge 310 of the cap in an abutting relation with stop surface 20 such that detent member 330 on the exterior surface of the cap is between detent member 22 and stop surface 20. A cross-sectional view of this position is shown in FIG. 4A. When the cap 300, and the upper 200 and lower 100 sections of terminal are in this first position, the left hand portion of upper wire receiving opening 320 in cap 300 is in alignment with large wire opening 212 in the outer portion of the terminal. At the same time, the left hand portion of upper wire receiving opening 320 is in alignment with large wire receiving opening 170 in lower terminal section 100, and with small wire receiving opening 150 in lower terminal section 100, and with small wire opening 222 and large wire opening 212 in upper terminal section 200. Similarly, the left hand portion of lower wire receiving opening 326 in cap 300 is in alignment with openings 232, 180, 160 and 242. When cap 300 and upper terminal section 200 are placed within the silo such that lower edge 316 of the circular portion 302 is in an abutting relation with top surface 9 of the silo, slots 206 and 208 of upper terminal section 200 are overlying contact members 190 on lower terminal section 100.

Figure 10:
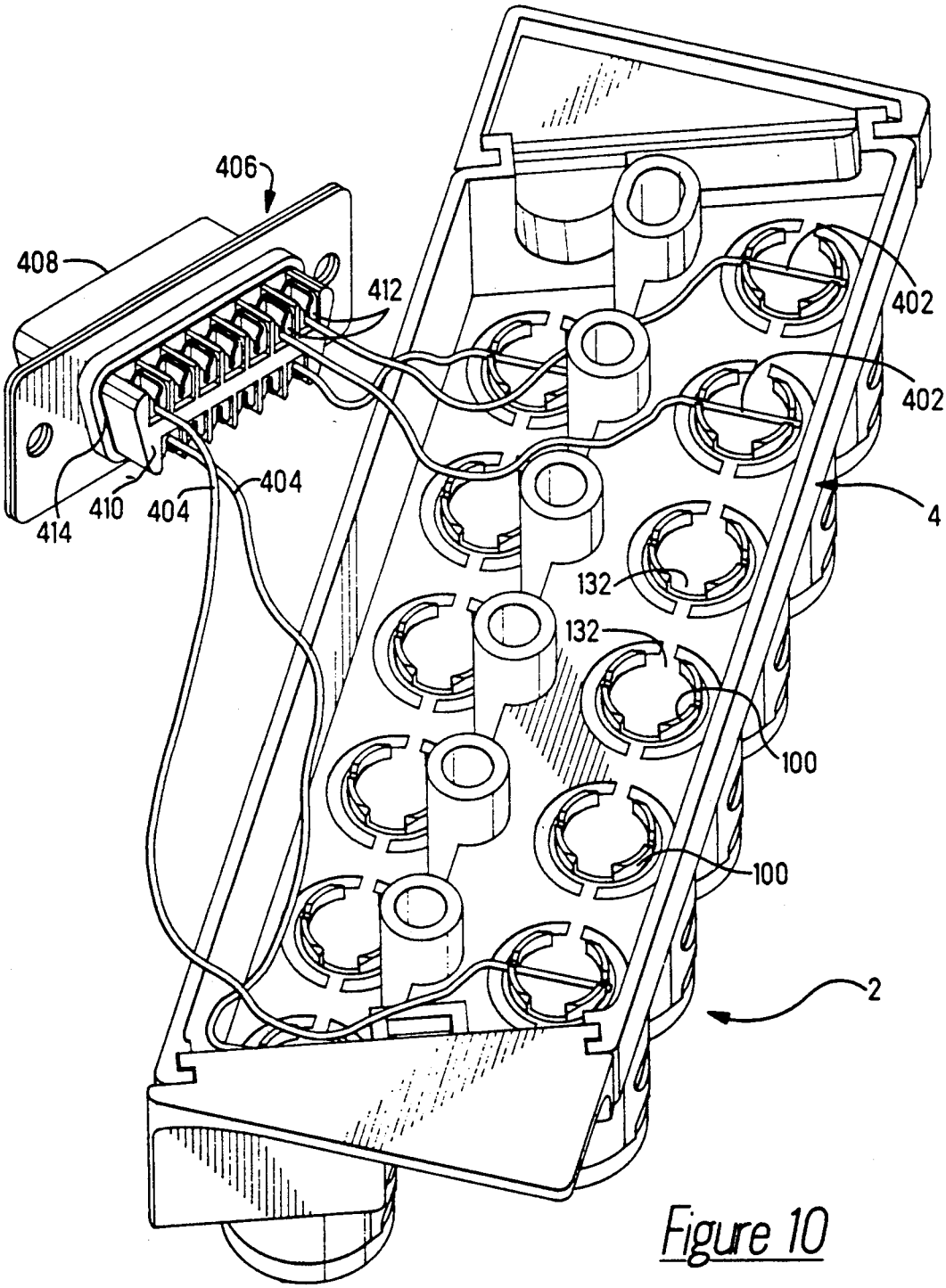
FIG. 10 is a bottom plan view showing the underside of the connector with discrete wires in a terminated condition.

As shown in FIG. 10, connector 2 is prepared for field use by terminating first ends 402 of discrete wires 400 to the respective lower insulation displacement sections 132 of lower terminal sections in a conventional manner. Second ends 404 of the discrete wires 400 are then terminated to a second electrical connector 406. The second electrical connector 406 can be any type of connector which has a mating face 408 and a wire receiving face 410. In the particular configuration shown in FIG. 10, the discrete wires 400 are terminated to the second electrical connector 406 by means of insulation displacement contacts 412. Consequently, with respective ends 402, 404 of the discrete wires 400 electrically connected to lower terminals sections 100 of connector 2 and contacts 412 of second electrical connector 406, contacts 412 of second electrical connector 406 are placed in electrical engagement with lower terminal sections 100 of connector 2.

Figure 11:
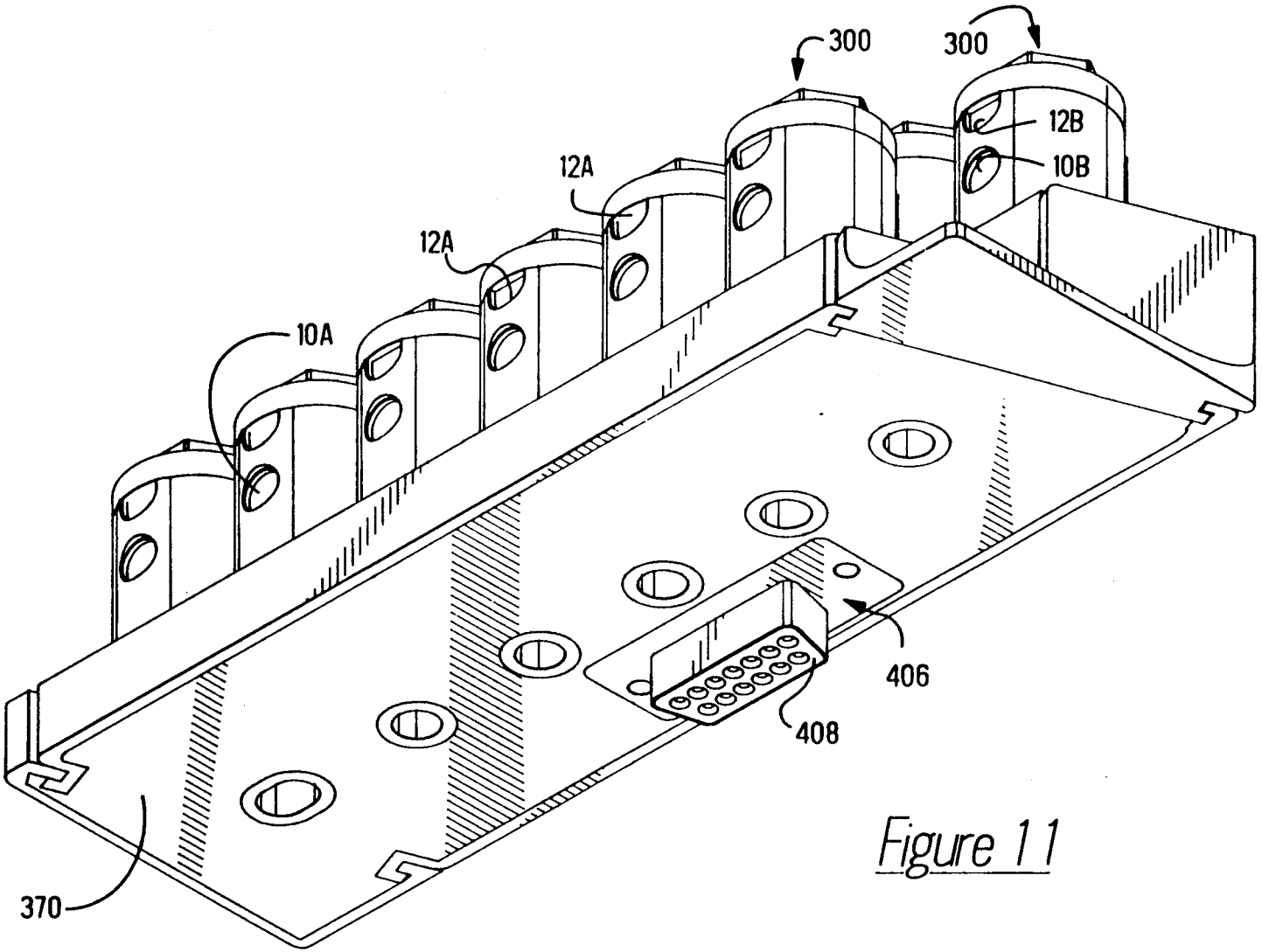
FIG. 11 is a bottom perspective view showing the the terminal block in a fully assembled condition.

After the discrete wires 400 have been terminated to lower terminal sections 100 of connector 2 and contacts 412 of second connector 406, the housing 4 is positioned in a configuration such that caps 300 and lower and upper terminal sections 100, 200 are facing downwardly, the upstanding side walls 80 of the housing 4 and the end walls form a cavity with the upstanding sidewalls of the housing higher than the protruding portions of lower terminal sections 100. To environmentally protect the lower terminations, an epoxy resin 370 (FIG. 11) is poured into the cavity to completely cover the insulation displacement portions 132 and the individual discrete wires extending generally transversely from lower terminal sections 100 to connector 2. A back portion 414 of the second electrical connector 406 is also positioned in the epoxy 370, as shown in FIG. 11. This insures that the electrical connection between connector 2 and the second electrical connector 406 will be environmentally sealed. It is also important to note that the epoxy 370 acts as a means to retain the second electrical connector 406 in position relative to connector 2. The array is then ready for field pedestal installation, or for mounting within an enclosed aerial mounting box or pole.

The use of the second electrical connector 406 eliminates the need to connect the individual wires of the multi-conductor cable used in the prior art connectors to the corresponding wires of the telephone company. As the second electrical connector 406 is provided to make the electrical connection to a pluggable mating connector on the pedestal, etc., the installation and replacement of the connectors 2 is greatly simplified. In the prior art, in which numerous individual wires extended from the connector, the installer was required to terminate each individual wire to a respective wire of the cable. This was a particularly costly operation, as a great deal of time was required in the field to complete the electrical connection. This problem was encountered in each instance in which a new connector was installed or in each instance in which an existing connector was replaced. The present invention eliminates this time consuming and costly operation, and allows the operator to merely plug in the connector to the mating connector on the pedestal, thereby greatly reducing the cost associated with the installation and repair. As the manual effort required by the installer is lessened, the probability of a positive electrical connection being effected is heightened.

With the connector in the configuration shown in FIGS. 1 and 4A, a further discrete wire can be terminated within the connector by inserting a discrete wire such as 370 or 372 through either of the through openings 10 or 12 in the silo. If the wire is a large gauge wire, the wire will project into the connector into the interior of the post 50 as far as surfaces 58 to prevent the wire from passing through the post into the small wire terminating section. Rather, if the discrete wire to be terminated has a small gauge, the wire freely passes through the section 60 in the post, through small wire openings 224, 244 and 150, 160 in both the upper and lower terminal sections, 200, 100, respectively and into channel 16 as shown in phantom in FIG. 4C.

Figure 4C:
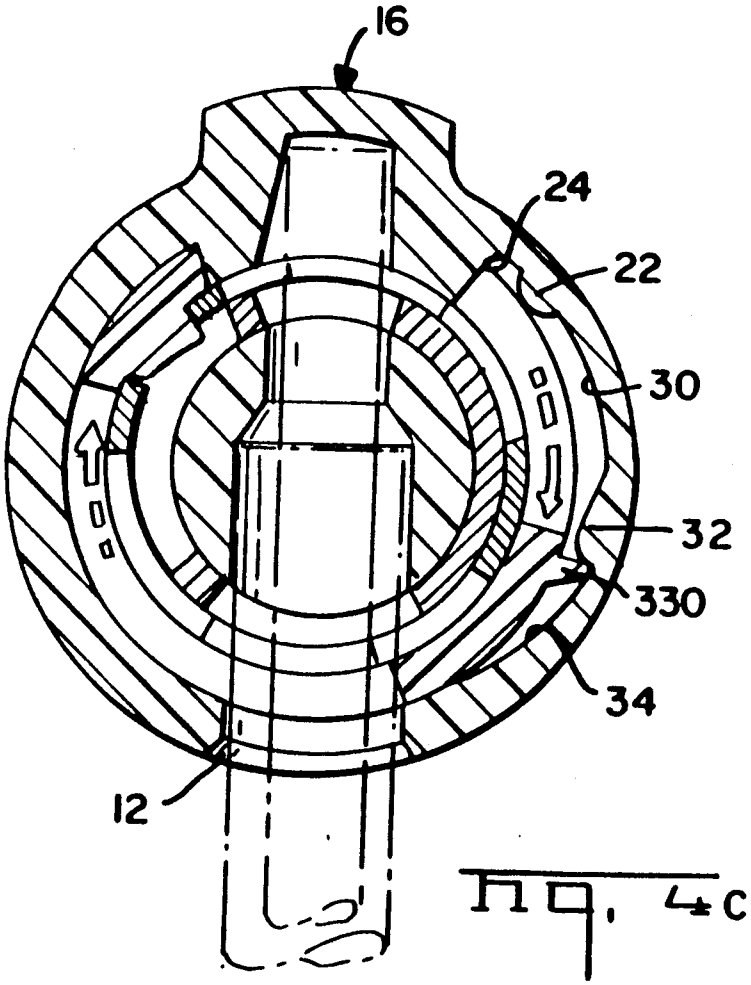
FIG. 4C is a view similar to that of FIGS. 4A and 4B showing the cap and upper terminal in the fully terminated condition.
Figure 4B:
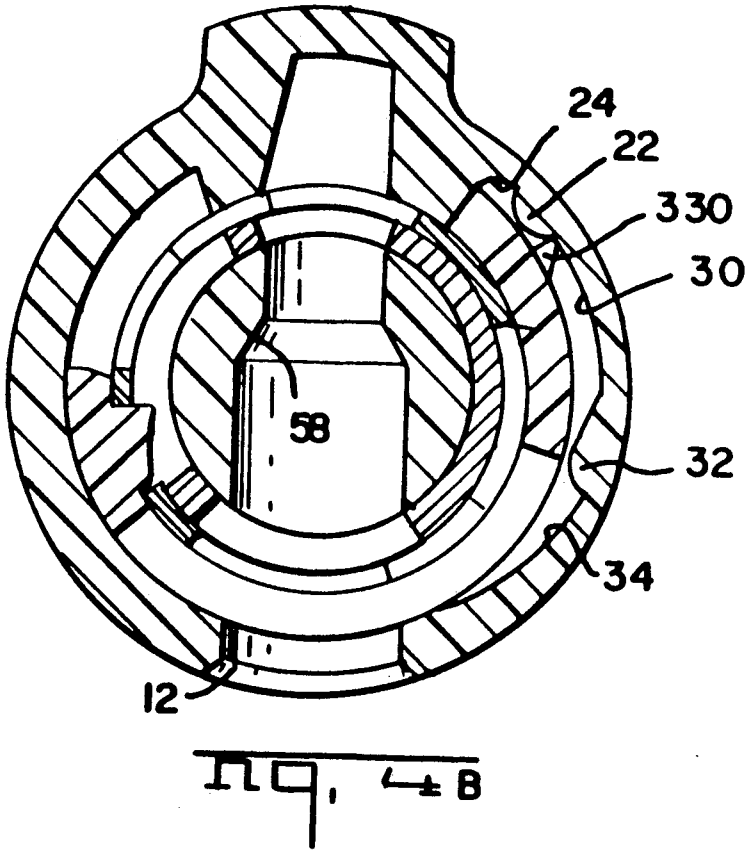
FIG. 4B is a view similar to that of FIG. 4A showing the cap through a first detent.

To terminate the wire into one of the respective slots 216–246, cap 300 is rotated in the clockwise direction as viewed in FIGS. 4A through 4C, and as the cap is first rotated, detent 330 on the outer surface of the cap passes detent 22 within the interior of the silo to the position shown in FIG. 4B. Continued rotation of the cap continues the rotation of upper terminal section 200 until the cap is rotated to the position shown in FIG. 4C where detent 330 is locked behind the complementary detent section 32 on the silo. With the cap rotated to the position shown in FIG. 4C, upper terminal section 200 is rotated into the insulated wire such that the conductor inside the insulated wire is placed centrally within one of the wire receiving edges 216, 226, 236 or 246, depending on the gauge of wire, and depending upon which wire receiving opening, 10 or 12, the insulated wire was inserted through. It should be appreciated that the wire receiving edges 216 through 246 have gaps between them, slightly smaller than the diameter of the conductor to be terminated such that movement of the wire into the slot causes the leading edges 214 through 244 to sever through the insulation of the insulated conductor and place the bared conductor between the edges 216 through 246 in a contacting relation.

It should be appreciated that the post acts as a selector for the particular gauge of wire to be inserted within the terminal and it acts as a bearing surface for the anti-rotation of the wire during the termination of the wire. Further bearing surfaces are provided by the leading edges of openings 170, 180, 150 and 160 in lower terminal section 100, and against the leading edges of openings 12 and 10, and of the channel 16. It should also be noted from the progression of FIGS. 4A through 4C that the wire remains in a straight condition during the termination thereof. Finally, the two piece terminal allows one terminal portion 100 to be fixed, while allowing the second terminal portion 200 to rotate relative to the first portion 100, yet maintain electrical continuity between the two by virtue of raised projections 190 on lower terminal section 100 being in contact with slots 206 and 208 in upper terminal section 200. The upper 200 and lower 100 terminal sections are kept in electrical engagement by the close proximity of the respective concentric surfaces of post 50, inner terminal portion 100, outer terminal portion 200, the inner and outer surfaces of cylindrical portion 306 of cap 300 and the inner surface 14 of silo 6 or 8, as shown in the FIGS. 4A–4C.

Other embodiments of the invention are foreseeable without departing from the scope of the claims herein. For instance, the terminal blocks or connectors can have terminals of varying configurations provided therein.

Changes in construction will occur to those skilled in the art and various apparently different modifications and embodiments may be made without departing from the scope of the invention. The matter set forth in the foregoing description and accompanying drawings is offered by way of illustration only.

The invention was described by way of preferred embodiment but should not be taken to limit the scope of the claims which follow.

What is claimed is:

1. An electrical connector assembly comprising:

a housing having a transverse base section, a plurality of terminal receiving housing sections coextending in a first direction from said base section each to a respective first end at a wire receiving face of said housing, each said end at a wire receiving face of said housing, each said terminal receiving housing section having a wall defining a terminal receiving cavity therein, and each said housing section wall including at least one wire receiving opening extending into the interior of said terminal receiving cavity near said first end;

a terminal disposed in each said terminal receiving cavity and extending from a first and at said first housing section end to a second end at least exposed along said base section of said housing, each said terminal having at least one first wire termination section near said first end associated with each said wire receiving opening and exposed for termination to a corresponding first wire, and at least one second wire termination section near said second end such that each said second wire termination section is exposed along said base section for termination to a corresponding second wire;

said housing further including a peripheral wall extending axially in a second opposed direction farther than said second end of each said terminal, said peripheral wall defining a large wire holding cavity adjacent said base section in communication with said second wire termination section of each said terminal;

second wires terminated at first ends thereof respectively each to a said terminal at said at least one second wire termination section thereof and including lengths disposed within said wire holding cavity and extending to second ends thereof, defining an interconnection face opposed from said wire receiving face of said housing;

an electrical connector including an integral dielectric housing and having a mating face and a wire receiving face, said connector including therewithin a plurality of other terminals terminated to said second ends of respective ones of said second wires with said second wires extending into said wire receiving face and said other terminals at least exposed along said mating face in a selected interface configuration for electrical connection to corresponding contacts of a mating connector at a selected location along said interconnection face of said housing; and hardenable sealant material disposed within said wire holding cavity embedding and sealing upon hardening thereof said terminal second ends, said wire receiving face of said electrical connector, and said second wires extending generally transversely therebetween, said sealant material further securing said connector to said housing at said selected location along an exposed surface of said sealant material after hardening thereof, whereby an integral electrical connector assembly is defined having a wire receiving face for first wires to be terminated to first wire termination sections of respective said terminals near said first ends thereof, and an opposed interconnection face for facilitating separable interconnection of all said terminals simultaneously with further respective conductor means at a selected mating interface located at said selected location without said terminals being subjected to strain during connector mating, and the selected mating interface enabling interconnection irrespective of the spacing and positioning of said terminals of the assembly.

2. An electrical connector assembly as recited in claim 1 wherein said at least one first wire termination section of each said terminal comprises insulation displacement means cooperable with an end of a respective said first wire inserted into a said wire receiving opening of said housing section wall to insure that said first wire is connectable with said terminal without requiring removal of insulation from said first wire.

3. An electrical connector assembly as recited in claim 2 wherein each said terminal includes inner and outer cylindrical sections, each said terminal receiving cavity is tubular, and each said terminal is disposed within a respective said tubular terminal receiving cavity in a manner permitting rotation of one of said inner and outer sections with respect to the other from a first position to a second position to form an electrical connection of said at lest one first wire termination section with a respective said first wire, the other of said inner and outer sections including said at least one second wire termination section terminated to a respective said second wire, and said terminal including means interconnecting said inner and outer sections at least in said second position and thereby being in electrical connection with said respective second wire and a said other terminal of said connector.

* * * * *